US010480471B2

(12) United States Patent
Otsuka

(10) Patent No.: US 10,480,471 B2
(45) Date of Patent: Nov. 19, 2019

(54) MOTORCYCLE FUEL SYSTEM WITH TWO INJECTORS POSITIONED IN THE INTAKE AIR PASSAGE

(71) Applicant: KAWASAKI JUKOGYO KABUSHIKI KAISHA, Kobe-shi, Hyogo (JP)

(72) Inventor: Masaya Otsuka, Himeji (JP)

(73) Assignee: KAWASAKI JUKOGYO KABUSHIKI KAISHA, Kobe-shi, Hyogo (JP)

( * ) Notice: Subject to any disclaimer, the term of this patent is extended or adjusted under 35 U.S.C. 154(b) by 211 days.

(21) Appl. No.: 15/474,985

(22) Filed: Mar. 30, 2017

(65) Prior Publication Data

US 2017/0292487 A1 Oct. 12, 2017

(30) Foreign Application Priority Data

Apr. 6, 2016 (JP) ..... 2016-076803

(51) Int. Cl.
*F02M 61/14* (2006.01)
*F02M 69/04* (2006.01)
(Continued)

(52) U.S. Cl.
CPC ..... *F02M 61/145* (2013.01); *F02M 35/02* (2013.01); *F02M 35/1017* (2013.01);
(Continued)

(58) Field of Classification Search
CPC .. F02M 61/145; F02M 35/02; F02M 35/1017; F02M 37/007; F02M 69/043; F02M 69/462; F02B 61/02
See application file for complete search history.

(56) References Cited

U.S. PATENT DOCUMENTS 4,216,753 A * 8/1980 Inoue ..... F02D 41/36 123/445
4,546,746 A * 10/1985 Sato ..... F02M 69/46 123/445
(Continued)

FOREIGN PATENT DOCUMENTS

JP 2004183538 A 7/2004
JP 2013137001 A 7/2013
(Continued)

*Primary Examiner* — Hung Q Nguyen
*Assistant Examiner* — Susan E Scharpf
(74) *Attorney, Agent, or Firm* — Alleman Hall Creasman & Tuttle LLP

(57) ABSTRACT

A vehicle which supplies a fuel from a fuel tank to an air-intake passage comprises a first injector which injects the fuel into the air-intake passage; a second injector which is disposed to be apart from the first injector in a flow direction of intake-air and injects the fuel into the air-intake passage; a fuel pump which discharges the fuel from the fuel tank; a first fuel tube, a first end of which is connected to the fuel pump; a second fuel tube, a first end of which is connected to the second injector; and a connector which is connected to a second end of the first fuel tube, a second end of the second fuel tube, and the first injector, and distributes the fuel from the first fuel tube, to the second fuel tube and the first injector, and the connector is firmly coupled to the first injector.

8 Claims, 6 Drawing Sheets

(51) Int. Cl.

| | |
|---|---|
| ***F02M 69/46*** | (2006.01) |
| ***F02M 35/02*** | (2006.01) |
| ***F02M 35/10*** | (2006.01) |
| ***F02M 37/00*** | (2006.01) |
| ***F02B 61/02*** | (2006.01) |

(52) U.S. Cl.
CPC ..... *F02M 37/007* (2013.01); *F02M 69/043* (2013.01); *F02M 69/462* (2013.01); *F02B 61/02* (2013.01)

(56) References Cited

U.S. PATENT DOCUMENTS 6,626,155 B1 * 9/2003 Ueda ..... B62J 35/00 123/509
6,843,219 B2 * 1/2005 Matsuda ..... F02M 35/10032 123/184.21
7,401,597 B2 * 7/2008 Koike ..... B62J 35/00 123/509
7,448,363 B1 * 11/2008 Rasmussen ..... F02D 41/062 123/179.17
7,451,744 B2 * 11/2008 Imamura ..... F02M 35/10072 123/184.21
7,992,901 B2 * 8/2011 Hirano ..... B62J 35/00 280/833
2001/0027776 A1 * 10/2001 Amou ..... F02D 41/3094 123/478
2004/0079340 A1 * 4/2004 Matsuda ..... F02M 35/10032 123/472
2005/0173918 A1 * 8/2005 Eguchi ..... B62J 35/00 280/834
2005/0205067 A1 * 9/2005 Koide ..... F02M 35/10039 123/470
2006/0162691 A1 * 7/2006 Ishida ..... F02D 9/02 123/337
2007/0227509 A1 * 10/2007 Ueda ..... F01L 1/022 123/509
2008/0184961 A1 * 8/2008 Miyashiro ..... F01N 13/20 123/445
2008/0210201 A1 * 9/2008 Akagi ..... F02M 69/042 123/469
2011/0011373 A1 * 1/2011 Shimura ..... F02D 41/3082 123/497
2011/0174273 A1 * 7/2011 Otsuka ..... F02M 35/10032 123/470
2011/0315099 A1 * 12/2011 Uchiyama ..... B62J 37/00 123/54.4
2012/0265423 A1 * 10/2012 Kai ..... F02D 41/30 701/104
2013/0167805 A1 * 7/2013 Otsuka ..... F02M 37/007 123/468
2015/0007794 A1 * 1/2015 Kawata ..... F02M 69/042 123/445

FOREIGN PATENT DOCUMENTS

JP 2013147970 A 8/2013
JP 2015014211 A 1/2015

* cited by examiner

MOTORCYCLE FUEL SYSTEM WITH TWO INJECTORS POSITIONED IN THE INTAKE AIR PASSAGE

CROSS-REFERENCE TO THE RELATED APPLICATION

This application claims priority to and the benefit of Japanese Patent Application No. 2016-076803 filed on Apr. 6, 2016, the entire disclosure of which is incorporated herein by reference.

BACKGROUND OF THE INVENTION

Field of the Invention

The present invention relates to a vehicle.

Description of the Related Art

A vehicle such as a motorcycle includes an air-intake passage through which intake-air to be supplied to an engine flows, a fuel pump which discharges a fuel from a fuel tank, a fuel tube through which the fuel discharged from the fuel pump flows, and a plurality of injectors which inject into the air-intake passage the fuel which has flowed through the fuel tube.

As disclosed in Japanese Laid-Open Patent Application Publication No. 2013-137001, a fuel tube includes, for example, a main tube, and a plurality of sub-tubes which branch from the main tube. The main tube is connected to a fuel pump, and the plurality of sub-tubes are connected to a plurality of injectors, respectively.

In the vehicle, if fuel tube pipe structures connecting the fuel pump to the plurality of injectors are complex, then it becomes difficult to efficiently lay out the fuel pump, the plurality of injectors, and the fuel tubes in a limited inner space of the vehicle.

In view of the above-described circumstances, an object of the present invention is to provide a vehicle which can simplify the fuel tube pipe structures connecting the fuel pump to the plurality of injectors.

SUMMARY OF THE INVENTION

According to an aspect of the present invention, a vehicle which supplies a fuel stored in a fuel tank to an air-intake passage through which intake-air flows, the intake-air being supplied to an engine which generates driving power for allowing the vehicle to travel, comprises a first injector which injects the fuel into the air-intake passage; a second injector which is disposed to be apart from the first injector in a flow direction of the intake-air flowing through the air-intake passage and injects the fuel into the air-intake passage; a fuel pump which discharges the fuel from the fuel tank; a first fuel tube, a first end of which is connected to the fuel pump; a second fuel tube, a first end of which is connected to the second injector; and a connector which is connected to a second end of the first fuel tube, a second end of the second fuel tube, and the first injector, and distributes the fuel which has flowed through the first fuel tube, to the second fuel tube and the first injector, wherein the connector is firmly coupled to the first injector.

In accordance with this configuration, since the connector which is connected to the second end of the first fuel tube, the second end of the second fuel tube, and the first injector, and distributes the fuel which has flowed through the first fuel tube, to the second fuel tube and the first injector, is joined to the first injector, it is not necessary to connect to the second end of the first fuel tube and the first injector a sub-tube for flowing the fuel from the first fuel tube toward the first injector. In this layout, the first and second fuel tubes can be arranged in series. As a result, the fuel tube pipe structures connecting the fuel pump to the first and second injectors can be simplified.

In addition, since the connector is firmly coupled to the first injector, the relative positions of the coupling portions of the connector and the first injector are not changed. This makes it possible to prevent the first and second fuel tubes from being displaced with respect to the first injector.

Therefore, it becomes possible to prevent a situation in which the first and second fuel tubes contact, interfere with or get tangled in other members of the vehicle, without providing a complex structure as the pipe structures of the first and second fuel tubes disposed in the inner space of the vehicle.

The connector may be connected to the first fuel tube and the second fuel tube in the flow direction of the intake-air, and connected to the first injector in a direction crossing the flow direction of the intake-air.

In accordance with this configuration, since the connector is connected to the first and second fuel tubes in the flow direction of the intake-air, the lengths of the first and second fuel tubes can be reduced, and the fuel tube pipe structures can be easily made compact in the flow direction. Since the connector is connected to the first injector in the direction crossing the flow direction, the fuel can be easily delivered from the first fuel tube to the first injector via the connector, without stretching the first fuel tube or the second fuel tube in the direction crossing the flow direction.

In addition, since the first and second fuel tubes are connected to the connector firmly coupled to the first injector, the first and second fuel tubes can be mounted on the vehicle body of the vehicle while stably positioning the first and second fuel tubes, without using positioning members, in a state in which the first and second fuel tubes are connected to the connector in the flow direction. In this configuration, compared to a conventional example in which the fuel tubes are required to be mounted on the vehicle body of the vehicle, by use of the positioning members, the mounting structure for mounting the fuel tube pipe structures on the vehicle body of the vehicle does not become complex.

Further, since the first and second fuel tubes are connected to the connector firmly coupled to the first injector, a direction in which the first and second fuel tubes are connected to each other, and a direction in which the connector and the first injector are connected to each other are not changed. In this configuration, even when a vibration is transmitted to the first and second fuel tubes while the vehicle is traveling, the direction in which the first and second fuel tubes are connected to each other, and the direction in which the connector and the first injector are connected to each other can be stably maintained.

At least one of the first fuel tube and the second fuel tube may be connected to the connector in such a manner that at least one of the first and second fuel tubes is relatively rotatable in a circumferential direction of the first fuel tube, with respect to the connector.

In accordance with this configuration, at least one of the first fuel tube and the second fuel tube is connected to the connector in such a manner that at least one of the first and second fuel tubes is relatively rotatable in the circumferential direction of the first fuel tube, with respect to the connector. Therefore, in a case where the first fuel tube or the second fuel tube is moved, at least one of the first and second fuel tubes is relatively rotated in the circumferential direction of the first fuel tube with respect to the connector, while maintaining the relative positions of the coupling portions of the connector and the first injector. This makes it difficult to deform the first fuel tube or second fuel tube.

For example, in a case where a work for detaching the fuel pump from the vehicle body of the vehicle together with the fuel tank is performed, it becomes possible to prevent a situation in which the relative positions of the coupling portions of the connector and the first injector are changed, and thereby the fuel tube pipe structures contact, interfere with or get tangled in other members of the vehicle. In addition, it becomes possible to prevent the first fuel tube or the second fuel tube from being twisted or broken. Thus, the work efficiency can be improved.

The first fuel tube may be curved at two points in different directions. In accordance with this configuration, since the first fuel tube is curved at two points in different directions, the first fuel tube can be easily disposed in the inner space of the vehicle, while preventing a situation in which the first fuel tube contacts, interferes with or gets tangled in other members of the vehicle.

In addition, since first fuel tube is curved at two points in different directions, a distance between the fuel pump and the first injector can be made different between a state in which the fuel pump is mounted on the vehicle body and a state in which the fuel pump is detached from the vehicle body. Therefore, in the state in which the fuel pump is mounted on the vehicle body, the first fuel tube can be compactly accommodated in the inner space of the vehicle. In contrast, in the state in which the fuel pump is detached from the vehicle body, the first injector and the fuel pump can be made distant from each other by stretching the first fuel tube, and the fuel pump and the first fuel tube can be easily lifted up.

Further, by stretching the first fuel tube in a state in which the connector is firmly coupled to the first injector, it becomes possible to prevent a situation in which the fuel tube pipe structures, which are other than the first fuel tube, are lifted up and get tangled in other members of the vehicle. Therefore, the work for detaching the fuel pump from the vehicle body can be efficiently performed.

Moreover, in a case where the fuel pump is detached from the vehicle body, the first injector and the fuel pump can be made distant from each other by stretching the first fuel tube. This makes it possible to increase the efficiency of, for example, a work for detaching the first fuel tube from the fuel pump or the connector and mounting the first fuel tube on the fuel pump or the connector.

The fuel pump may be mounted on a lower portion of the fuel tank, the first fuel tube, the second fuel tube, and the connector may be disposed below the fuel tank, and the first injector may be disposed to overlap with the fuel tank in a vertical direction.

In accordance with this configuration, the fuel pump is mounted on the lower portion of the fuel tank, and the first fuel tube, the second fuel tube, and the connector are disposed below the fuel tank. Since the connector is firmly coupled to the first injector, it becomes possible to prevent a situation in which the fuel tube pipe structures are lifted up from a location that is below the fuel tank and get tangled in other members of the vehicle, in a case where the fuel pump is detached from the vehicle body, together with the fuel tank. As a result, the work efficiency can be improved.

In addition, since the fuel pump is mounted on the lower portion of the fuel tank, and the first injector is positioned to overlap with the fuel tank in the vertical direction, the fuel pump and the first injector can be disposed to be close to each other, at a location below the fuel tank. In this layout, the length of the first fuel tube can be reduced, and the fuel tube pipe structures can be easily made compact.

The vehicle may further comprise a joint member into which the second end of the first fuel tube and a first end of the connector are inserted, the joint member being engageable with the second end of the first fuel tube or the first end of the connector to connect the first fuel tube and the connector to each other in such a manner that the first fuel tube and the connector are detachable from each other; and a fastening member which is provided on an outer periphery of the second end of the second fuel tube, and externally presses connection portions of the second fuel tube and the connector to fasten the second fuel tube to the connector.

In the configuration which uses the joint member and the fastening member, for example, in a case where a work for detaching the fuel pump from the vehicle body together with the first fuel tube, is performed, the fuel pump and the first fuel tube can be easily detached from the vehicle body by pulling the second end of the first fuel tube or the first end of the connector out of the joint member, while maintaining a state in which the second fuel tube is fastened to the connector with a relatively simple structure by use of the fastening member. Since the fastening member is provided on the outer periphery of the second end of the second fuel tube, and externally presses connection portions of the second fuel tube and the connector to fasten the second fuel tube to the connector, it is not necessary to increase the length of the second fuel tube to allow the second fuel tube to be provided with the fastening member. Therefore, the fuel tube pipe structures can be easily made compact.

The vehicle may further comprises a throttle body connected to the engine; and an air cleaner connected to the throttle body, the fuel pump may be positioned so that a distance between the fuel pump and the throttle body is smaller than a distance between the fuel pump and the air cleaner, the air-intake passage may include an inner passage of the throttle body and an inner passage of the air cleaner, the first injector may be connected to the throttle body, and the second injector may be connected to the air cleaner.

In accordance with this configuration, in a state in which the throttle body is connected to the engine, the air cleaner is connected to the throttle body, and the fuel pump is positioned so that a distance between the fuel pump and the throttle body is smaller than a distance between the fuel pump and the air cleaner, the first injector is connected to the throttle body and the second injector is connected to the air cleaner. In this configuration, the first and second fuel tubes are arranged in series in a direction from the fuel pump toward the air cleaner to which the second injector is connected, by way of the throttle body to which the first injector is connected. Therefore, in this layout, the fuel can be injected from the first injector into the inner passage of the throttle body, and the fuel can be injected from the second injector into the inner passage of the air cleaner, while simplifying the fuel tube pipe structures.

The vehicle may be a motorcycle, and the engine may be a single-cylinder engine.

In a case where the vehicle is a motorcycle including the single-cylinder engine which generates the driving power for allowing the vehicle to travel, the first and second fuel tubes can be arranged in series in the flow direction of the intake-air, and the fuel tube pipe structures can be easily formed to have a linear shape having one or more branch points, by providing the first and second injectors on the single air-intake passage through which the intake-air to be supplied to the engine flows. Therefore, it becomes possible to prevent the fuel tube pipe structures from becoming complex, and efficiently dispose the fuel pump, the plurality of injectors, and the first and second fuel tubes in the inner space of the vehicle.

In accordance with the present invention, it becomes possible to simplify the fuel tube pipe structures connecting the fuel pump to the plurality of injectors.

The above and further objects, features and advantages of the present invention will more fully be apparent from the following detailed description of preferred embodiment with reference to the accompanying drawings.

DETAILED DESCRIPTION OF THE EMBODIMENTS

Hereinafter, the embodiment the present invention will be described with reference to the drawings. The stated directions are from the perspective of a rider straddling a motorcycle 1. A vehicle width direction of the vehicle body of the motorcycle 1 corresponds with a rightward and leftward direction.

Figure 1:
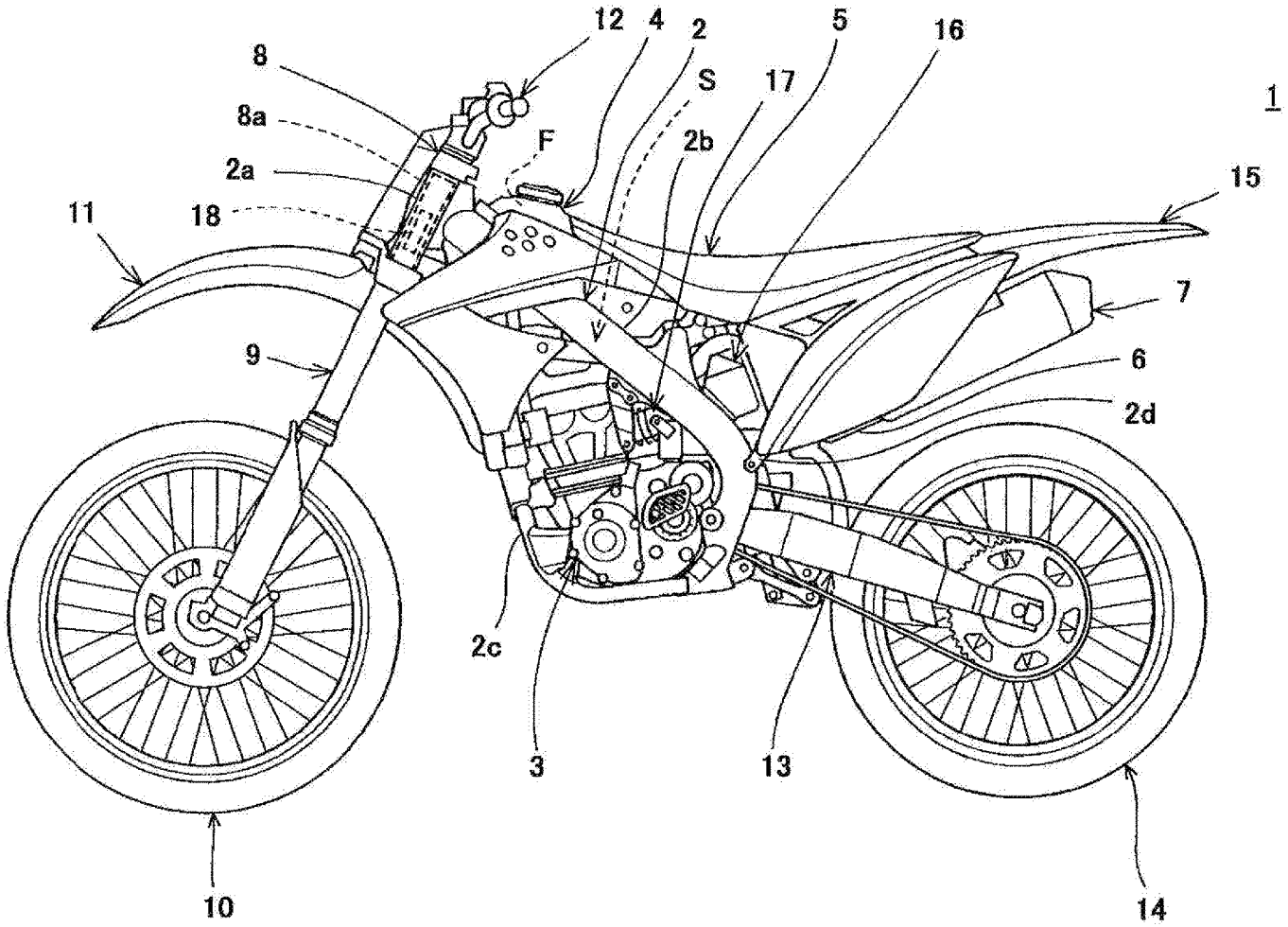
FIG. 1 is a left side view of a motorcycle according to the embodiment of the present invention.

FIG. 1 is a left side view of the motorcycle 1 according to the embodiment of the present invention. As shown in FIG. 1, the motorcycle 1 is an exemplary vehicle, and includes a vehicle body frame 2, an engine 3 which generates driving power for allowing the motorcycle 1 to travel, a fuel tank 4, a seat 5 which can be straddled by the rider, an exhaust pipe 6, a muffler 7, a steering member 8, a pair of front forks 9, a front wheel 10, a front fender 11, a handle 12, a swing arm 13, a rear wheel 14, a rear fender 15, an air cleaner 16, a throttle body 17, and an electronic control unit (ECU) 18. In the present embodiment, the motorcycle 1 is a Motocrosser.

The vehicle body frame 2 includes a head pipe 2*a*, a main frame member 2*b*, a center frame member 2*c*, and a rear frame member 2*d*. The head pipe 2*a* is provided at the front portion of the vehicle body frame 2 and extends vertically. The main frame member 2*b* extends rearward from the head pipe 2*a*. The center frame member 2*c* extends downward from the head pipe 2*a*, and then rearward at a location below the engine 3. The rear frame member 2*d* extends rearward from the rear portion of the main frame member 2*b*.

The engine 3 outputs the driving power for rotating the rear wheel 14. The engine 3 is, for example, a single-cylinder engine, and is mounted on the vehicle body frame 2, at a center location in a forward and rearward direction of the motorcycle 1. The fuel tank 4 contains fuel F to be supplied to the engine 3. The fuel tank 4 is disposed above the engine 3 to overlap with the engine 3 in a vertical direction. The fuel tank 4 is mounted on the vehicle body frame 2. An inner space S extending in the forward and rearward direction is provided between the engine 3 and the fuel tank 4.

The seat 5 is disposed behind the fuel tank 4 and supported on the vehicle body frame 2. Through the exhaust pipe 6, an exhaust gas emitted from the engine 3 flows. The exhaust pipe 6 extends rearward from the engine 3 on a first side (right side in the present embodiment) in the vehicle width direction, and is connected to the muffler 7. The muffler 7 is configured to muffle (silence) a noise emitted from the engine 3. The muffler 7 is disposed on the first side (right side) in the vehicle width direction with respect to the rear wheel 14, and extends in the forward and rearward direction.

The steering member 8 includes a steering shaft 8*a*, and retains a pair of front forks 9. The steering shaft 8*a* is rotatably supported by the head pipe 2*a*. The steering member 8 is rotatable together with the handle 12 within a predetermined rotational angle range around the axis of the steering shaft 8*a*.

The front wheel 10 is rotatably supported by the front end portions of the pair of front forks 9. The front fender 11 is supported by the front forks 9 at a location that is above the front wheel 10. The handle 12 is secured to the upper portion of the steering member 8.

The swing arm 13 is disposed rearward relative to the engine 3 and extends in the forward and rearward direction. The front end portion of the swing arm 13 is mounted on the main frame member 2*b*. The swing arm 13 is vertically pivotable around the front end portion mounted on the main frame member 2*b*. The rear wheel 14 is rotatably mounted on the rear end portion of the swing arm 13. The driving power generated by the engine 3 is transmitted to the rear wheel 14 via a driving power transmission mechanism (not shown). The rear fender 15 is supported on the vehicle body frame 2 at a location that is above the rear wheel 14.

The air cleaner 16 is configured to clean intake-air to be supplied to the engine 3. The air cleaner 16 is connected to the rear portion of the throttle body 17. The throttle body 17 serves to adjust the amount of the intake-air to be supplied to the engine 3. In the present embodiment, the throttle body 17 is connected to the rear portion of the engine 3.

The ECU 18 is connected to a first injector 24 and a second injector 25 which will be described later. The ECU 18 controls the injection amounts of the fuel F to be injected by the first and second injectors 24, 25, and the injection timings of the first and second injectors 24, 25. The ECU 18 controls a part of the opening/closing operations of a throttle valve 20 (see FIG. 5) of the throttle body 17. In addition, the ECU 18 performs other controls required for the engine 3. For example, the ECU 18 is disposed in front of the head pipe 2*a*.

Figure 2:
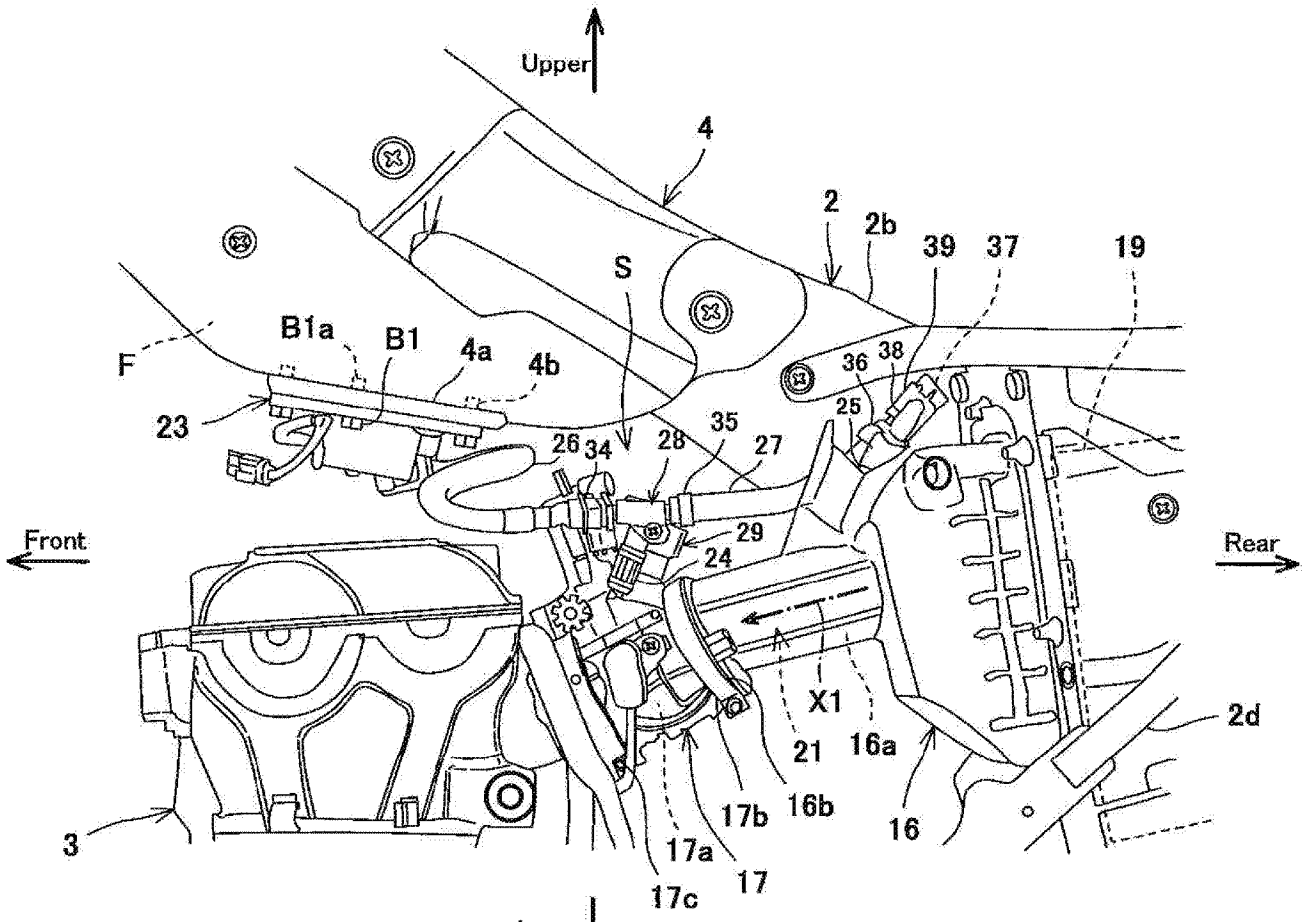
FIG. 2 is a left side view of an air cleaner, a throttle body, and a fuel pump unit of the motorcycle of FIG. 1.
Figure 3:
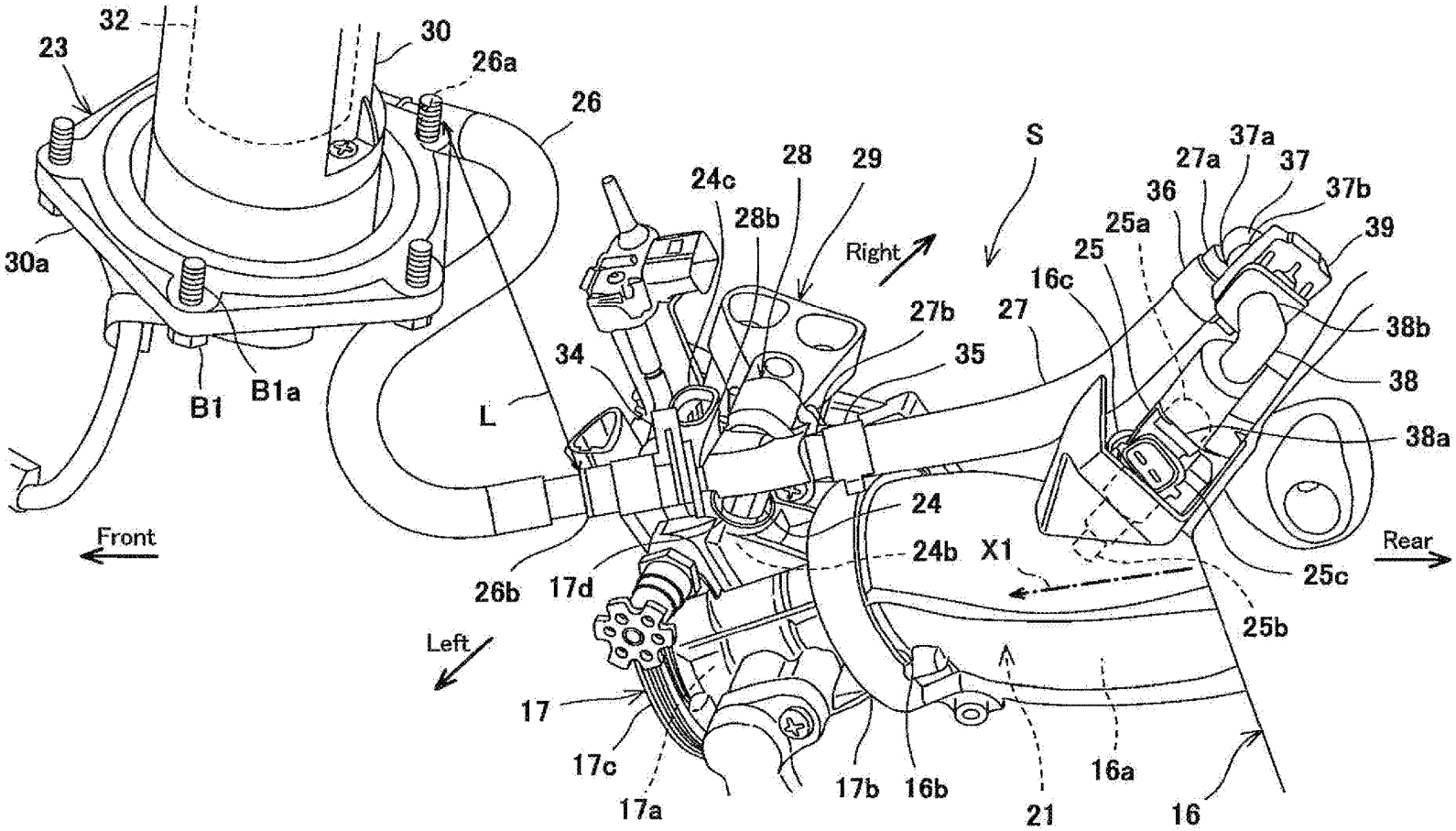
FIG. 3 is a perspective view of the air cleaner, the throttle body, and the fuel pump unit of the motorcycle of FIG. 1, when viewed obliquely from the left and the rear.
Figure 4:
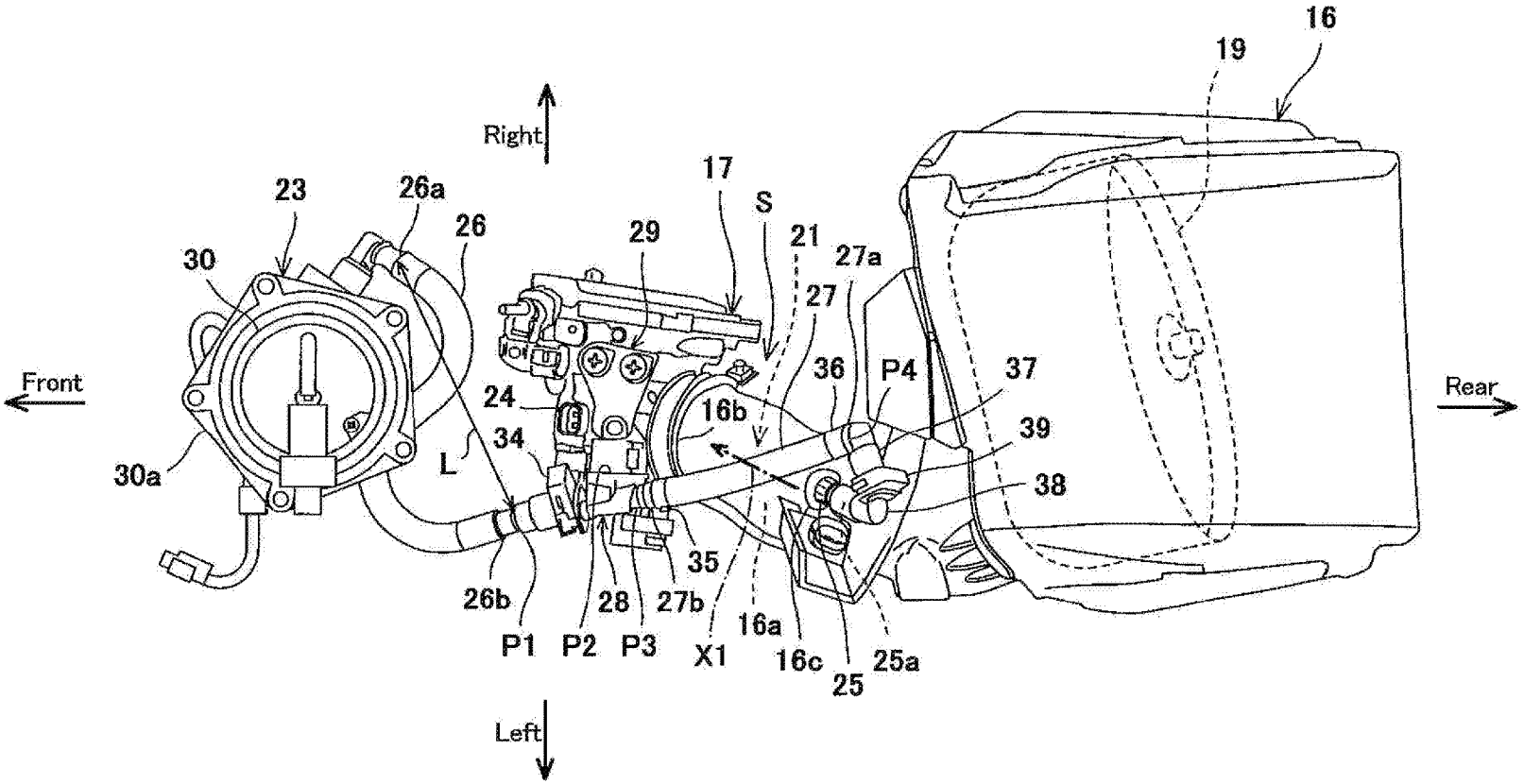
FIG. 4 is a plan view of the air cleaner, the throttle body, and the fuel pump unit of the motorcycle of FIG. 1.

FIG. 2 is a left side view of the air cleaner 16, the throttle body 17, and a fuel pump unit 23 of the motorcycle 1 of FIG. 1. FIG. 3 is a perspective view of the air cleaner 16, the throttle body 17, and the fuel pump unit 23 of the motorcycle 1 of FIG. 1, when viewed obliquely from the left and the rear. FIG. 4 is a plan view of the air cleaner 16, the throttle body 17, and the fuel pump unit 23 of the motorcycle 1 of FIG. 1.

As shown in FIGS. 2 to 4, the air cleaner 16 includes an inner passage 16*a*, a connection section 16*b*, and a filter element 19. The intake-air to be supplied to the engine 3 flows through the inner passage 16*a*. In an exemplary structure, the inner passage 16*a* extends to be tilted in a downward direction from the rear to the front. The connection section 16*b* is connected to the throttle body 17. The filter element 19 is disposed inside the inner passage 16*a* and configured to filter the intake-air flowing to the engine 3 through the inner passage 16*a*.

The throttle body 17 includes an inner passage 17*a*, a first connection section 17*b*, and a second connection section 17*c*. The intake-air to be supplied to the engine 3 flows through the inner passage 17*a*. The first connection section 17*b* is connected to the connection section 16*b* of the air cleaner 16. The second connection section 17*c* is connected to the engine 3.

The motorcycle 1 includes an air-intake passage 21 through which the intake-air to be supplied to the engine 3 flows. The air-intake passage 21 extends in the forward and rearward direction, and includes the inner passage 17*a* of the throttle body 17 and the inner passage 16*a* of the air cleaner 16.

The motorcycle 1 further includes the fuel pump unit 23, the first injector 24, the second injector 25, a first fuel tube 26, a second fuel tube 27, a connector 28, a connection unit 29, a first joint member 34, a first fastening member 35, a second fastening member 36, a first pipe member 37, a second pipe member 38, and a second joint member 39. In the present embodiment, the members 23 to 29, and 34 to 39 are accommodated in the inner space S. The members 23 to 29, 34, and 35 are disposed below the fuel tank 4.

The fuel pump unit 23 includes a fuel pump 30. The fuel pump 30 includes a mounting plate section 30*a* integrated with a casing of the fuel pump 30, and a motor 32 which is a drive source for the fuel pump 30. The fuel pump 30 discharges the fuel F from the fuel tank 4. The mounting plate section 30*a* is connected to the lower portion of the fuel pump 30. For example, the fuel pump unit 23 is disposed to overlap with the fuel tank 4 in the vertical direction.

By fastening male threads B1*a* of a plurality of bolts B1 inserted into the mounting plate section 30*a* to a plurality of female threads 4*b* provided at the periphery of an opening 4*a* provided in the lower portion of the fuel tank 4, in a state in which the fuel pump 30 is inserted in the opening 4*a* of the fuel tank 4, the fuel pump unit 23 is mounted on the lower portion of the fuel tank 4. The fuel pump unit 23 is positioned so that a distance between the fuel pump unit 23 and the throttle body 17 is smaller than a distance between the fuel pump unit 23 and the air cleaner 16. For example, the fuel pump unit 23 is positioned to overlap with the engine 3 in the vertical direction.

The first injector 24 injects the fuel F into the air-intake passage 21. Specifically, the first injector 24 is connected to the throttle body 17, and injects the fuel F into the inner passage 17*a*. The first injector 24 is elongated, and includes a fuel introduction section 24*a* (see FIG. 5), a nozzle section 24*b*, and an ECU connection section 24*c*. For example, the first injector 24 is disposed to overlap with the fuel tank 4 in the vertical direction, and located below the fuel tank 4 and the fuel pump 30.

The fuel introduction section 24*a* is provided at a first end (one end) in the lengthwise direction of the first injector 24. The fuel introduction section 24*a* introduces the fuel F externally supplied, into the first injector 24. The nozzle section 24*b* is provided at a second end (the other end) in the lengthwise direction of the first injector 24. The nozzle section 24*b* injects the fuel F in a direction from the first end toward the second end in the lengthwise direction of the first injector 24. The ECU connection section 24*c* is provided at the side portion of the first injector 24, and connected to a wire extending from the ECU 18. The first injector 24 is mounted on the throttle body 17 in a state in which the nozzle section 24*b* is inserted into a mounting hole 17*d* provided in the throttle body 17.

The second injector 25 is positioned to be apart from the first injector 24 in a flow direction X1 of the intake-air flowing through the air-intake passage 21 (hereinafter this will be simply referred to as the flow direction X1), and injects the fuel F into the air-intake passage 21. Specifically, the second injector 25 is connected to the air cleaner 16 and injects the fuel F into the inner passage 16*a* of the air cleaner 16. As in the first injector 24, the second injector 25 includes a fuel introduction section 25*a*, a nozzle section 25*b*, and an ECU connection section 25*c*. The tip end of the nozzle section 25*b* of the second injector 25 is located above the tip end of nozzle section 24*b* of the first injector 24.

The second injector 25 is mounted on the air cleaner 16 in a state in which the nozzle section 25*b* is inserted into a mounting hole 16*c* provided in the air cleaner 16. The mounting hole 16*c* is located downstream of the filter element 19 of the air cleaner 16 in the flow direction X1.

Each of the first fuel tube 26 and the second fuel tube 27 extends in the forward and rearward direction. A first end (one end) 26*a* of the first fuel tube 26 is connected to the fuel pump 30, while a second end (the other end) 26*b* of the first fuel tube 26 is connected to the connector 28. The first end 26*a* is located to be higher than the second end 26*b*. The first fuel tube 26 is curved at two points in different directions. For example, the first fuel tube 26 is curved in a S-shape when viewed from above (in a plan view). In this configuration, a maximum distance between the fuel pump 30 and the first injector 24 in a state in which the fuel pump 30 is detached from the vehicle body of the motorcycle 1 and the first fuel tube 26 is stretched is set to be longer than a minimum distance between the fuel pump 30 and the first injector 24 in a state in which the fuel pump 30 is mounted on the vehicle body.

Desirably, the length of the first fuel tube 26 is set to be a value in a range of 110% or more and 300% or less of a minimum distance L between the position of the first end 26*a* of the first fuel tube 26 and the position of the second end 26*b* of the first fuel tube 26, in the inner space S. More desirably, the length of the first fuel tube 26 is set to be a value in a range of 120% or more and 200% or less of the minimum distance L. Most desirably, the length of the first fuel tube 26 is set to be a value in a range of 130% or more and 150% or less of the minimum distance L. Further, for example, the length of the first fuel tube 26 is set to a value greater than that of the second fuel tube 27.

A first end (one end) 27*a* of the second fuel tube 27 is connected to the second injector 25, while a second end 27*b* of the second fuel tube 27 is connected to the connector 28. The first end 27*a* is located to be higher than the second end 27*b*. For example, the second fuel tube 27 extends in the forward and rearward direction. The first end 27*a* is located rearward relative to the fuel introduction section 25*a*, and connected to the second injector 25 via a first pipe member 37, a second joint member 39, and a second pipe member 38.

The first fuel tube 26 and the second fuel tube 27 may be made of the same material or different materials. Further, for example, the first fuel tube 26 may be made of a material having a flexibility higher than that of the second fuel tube 27.

In the present embodiment, a connection position P1 of the first fuel tube 26 and the connector 28, a connection position P2 of the connector 28 and the connection unit 29, a connection position P3 of the second fuel tube 27 and the connector 28, and a connection position P4 of the second fuel tube 27 and the first pipe member 37 are located on the same side (e.g., on the left side) in the vehicle width direction.

In the present embodiment, to allow the fuel F injected from the nozzle sections 24*b*, 25*b* to be easily mixed with the intake-air flowing through the air-intake passage 21, the first and second injectors 24, 25 are disposed in a state in which the lengthwise direction of each of the first and second injectors 24, 25 crosses the lengthwise direction of the second fuel tube 27 and the flow direction X1. For example, the first injector 24 is disposed to be tilted in such a manner that the nozzle section 24*b* is located downstream of the fuel introduction section 24*a* in the flow direction X1, when viewed from the left in the vehicle width direction (in a left side view). Also, the second injector 25 is disposed to be tilted in such a manner that the nozzle section 25*b* is located downstream of the fuel introduction section 25*a* in the flow direction X1, when viewed from the left.

Since the connector 28 is mounted on the throttle body 17 via the connection unit 29, it becomes possible to prevent a situation in which the second fuel tube 27 is lifted up together with the fuel tank 4, even when the first fuel tube 26 is lifted up together with the fuel pump 30.

The connector 28 distributes the fuel F which has flowed through the first fuel tube 26 to the second fuel tube 27 and the first injector 24. The connector 28 is connected to the first fuel tube 26 and the second fuel tube 27 in the flow direction X1. The connector 28 is connected to the first injector 24 in a direction (the vehicle width direction in the present embodiment) crossing the flow direction X1. The connector 28 is firmly coupled to the first injector 24. In the present embodiment, the term "firmly coupled" means that two members coupled to each other remain coupled to each other without changing relative positions of coupling portions of the two members, even when an external force is applied to the coupling portions of the two members coupled to each other.

The connection unit 29 connects the connector 28 and the first injector 24 to each other. The connection unit 29 is disposed above the throttle body 17, and extends in the vehicle width direction and in the vertical direction.

The first joint member 34 connects the second end 26*b* of the first fuel tube 26 and a first end (first shaft section 28*b* which will be described later) of the connector 28. The second end 26*b* of the first fuel tube 26 and the first end of the connector 28 are inserted into the first joint member 34. The first joint member 34 is engaged with the second end 26*b* of the first fuel tube 26 or the first end of the connector 28, to connect the first fuel tube 26 and the connector 28 to each other in such a manner that that the first fuel tube 26 and the connector 28 are detachable from each other. In the present embodiment, the first joint member 34 is secured to the second end 26*b* of the first fuel tube 26, and is engaged with the first end of the connector 28. The first joint member 34 is configured to allow the first fuel tube 26 and the connector 28 to be relatively rotatable in the circumferential direction of the first fuel tube 26.

At least one of the first fuel tube 26 and the second fuel tube 27 is connected to the connector 28 in such a manner that at least one of them is relatively rotatable in the circumferential direction of the first fuel tube 26, with respect to the connector 28. In the present embodiment, the first joint member 34 allows the first fuel tube 26 to be relatively rotatable in the circumferential direction of the first fuel tube 26, with respect to the connector 28.

The first fastening member 35 is configured to fasten the second fuel tube 27 to the connector 28. The first fastening member 35 is provided on the outer periphery of the second end 27*b* of the second fuel tube 27. The first fastening member 35 externally presses connection portions of the second fuel tube 27 and the connector 28 to fasten the second fuel tube 27 to the connector 28. For example, the first fastening member 35 is a clamp. The second fastening member 36 has a configuration similar to that of the first fastening member 35. The second fastening member 36 is configured to fasten the second fuel tube 27 to the first pipe member 37.

Each of the first pipe member 37 and the second pipe member 38 is a pipe member bent at a predetermined angle. The first pipe member 37 extends from the first end 27*a* of the second fuel tube 27 and is bent toward the left of the second fuel tube 27. The second pipe member 38 extends from the left end portion of the second joint member 39 and is bent toward the fuel introduction section 25*a*. The second joint member 39 and the second pipe member 38 are disposed on the left side of the first end 27*a* of the second fuel tube 27. The second joint member 39 has a configuration similar to that of the first joint member 34. The second joint member 39 extends in the vehicle width direction, at a location that is rearward relative to the first end 27*a* of the second fuel tube 27.

A first end 37*a* of the first pipe member 37 is connected to the first end 27*a* of the second fuel tube 27, while a second end 37*b* of the first pipe member 37 is connected to the second joint member 39. A first end 38*a* of the second pipe member 38 is connected to the fuel introduction section 25*a*, while a second end 38*b* of the second pipe member 38 is engaged with the second joint member 39 and detachably connected to the second joint member 39. This allows the second fuel tube 27 to be detachably connected to the second injector 25.

By use of the first pipe member 37 and the second pipe member 38, the fuel F which has flowed through the second fuel tube 27 can be smoothly supplied to the fuel introduction section 25*a* of the second injector 25 through the first pipe member 37 and the second pipe member 38, without a need to bend the second fuel tube 27 toward the fuel introduction section 25*a*.

Figure 5:
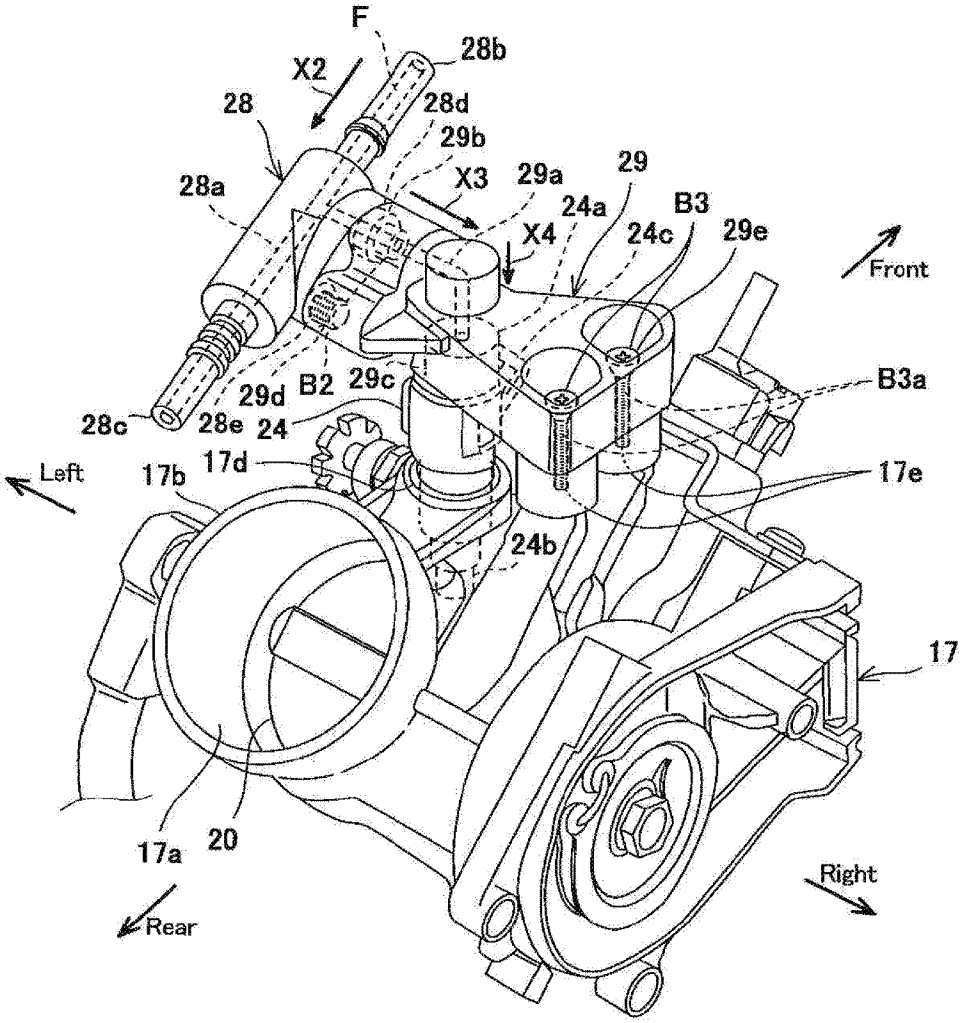
FIG. 5 is a perspective view of the throttle body, a connector, and a connection unit of the motorcycle of FIG. 1.
Figure 6:
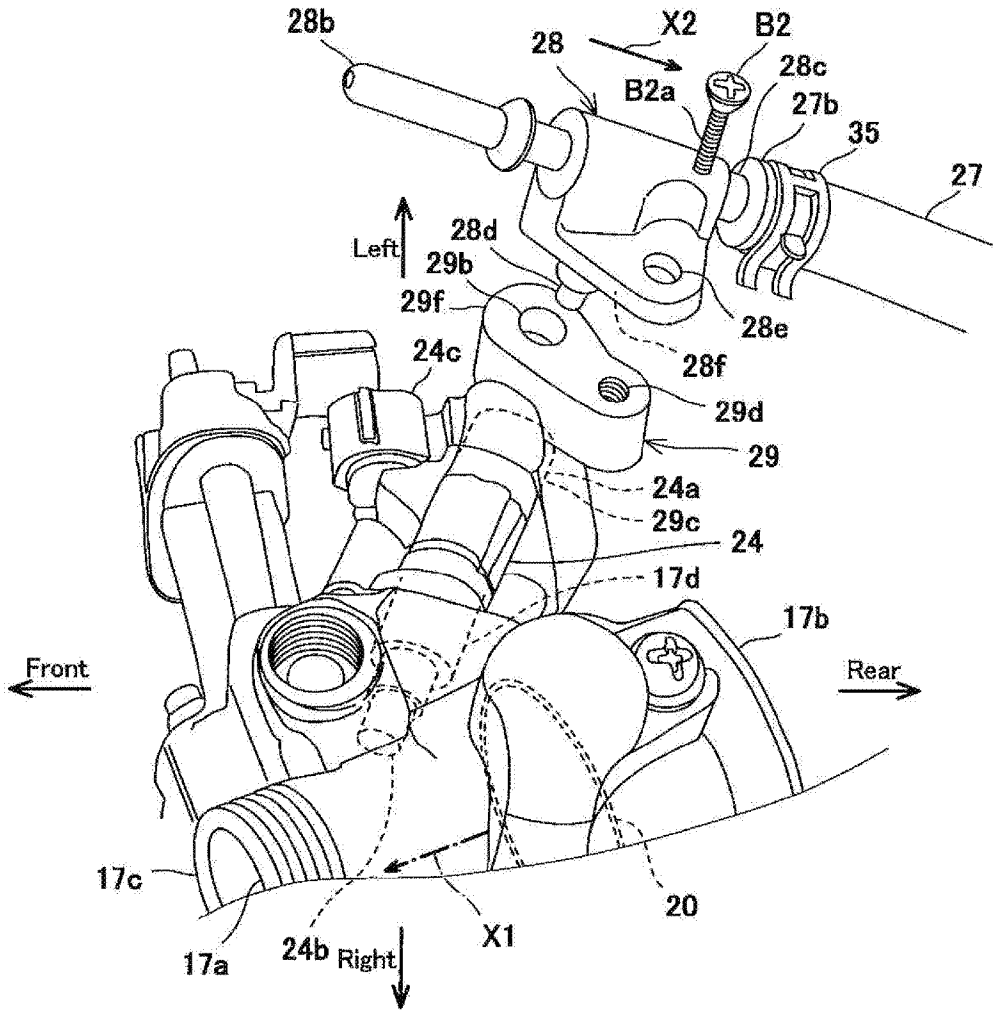
FIG. 6 is an exploded view of the connector and the connection unit of the motorcycle of FIG. 1.

FIG. 5 is a perspective view of the throttle body 17, the connector 28, and the connection unit 29 of the motorcycle 1 of FIG. 1. In FIG. 5, the interior of the right side portion of the throttle body 17 is shown. FIG. 6 is an exploded view of the connector 28 and the connection unit 29 of the motorcycle 1 of FIG. 1.

As shown in FIGS. 5 and 6, the throttle body 17 includes a throttle valve 20. The throttle valve 20 is provided in the inner passage 17*a* and is configured to control the amount of the intake-air flowing through the inner passage 17*a*. The mounting hole 17*d* is located downstream of the throttle valve 20 in the flow direction X1.

The connector 28 is connected to the left end portion of the connection unit 29, and extends in the forward and rearward direction. The connector 28 includes a first passage 28*a*, the first shaft section 28*b*, a second shaft section 28*c*, a third shaft section 28*d*, and an insertion hole 28*e*. The fuel F which has flowed through the first fuel tube 26 flows through the first passage 28*a*. The first passage 28*a* opens to an outside region at the tip ends of the first to fourth shaft sections 28*b* to 28*d*. The first passage 28*a* extends in a first direction X2 from the tip end of the first shaft section 28*b* toward the tip end of the second shaft section 28*c*. The first passage 28*a* branches at an intermediate portion and extends in a second direction X3 crossing the first direction X2, toward the tip end of the third shaft section 28*d*. For example, the first direction X2 conforms to the forward and rearward direction, while the second direction X3 conforms to the vehicle width direction.

The first shaft section 28*b* is inserted into the first joint member 34 and connected to the first joint member 34. The second shaft section 28*c* is inserted into the second fuel tube 27 and connected to the second fuel tube 27. The third shaft section 28*d* is inserted into the connection unit 29 and connected to the connection unit 29. A male thread B2*a* of a bolt B2 is inserted into the insertion hole 28*e*. A contact surface 28*f* of the connector 28 which contacts a contact surface 29*f* of the connection unit 29 is a flat surface.

The connection unit 29 is disposed above the throttle body 17 and extends to the left from a center of the throttle body 17 in the rightward and leftward direction (vehicle width direction). The connection unit 29 includes a second passage 29*a*, a first connection hole 29*b*, a second connection hole 29*c*, a female thread 29*d*, and a plurality of insertion holes 29*e*. The fuel F which has flowed through the connector 28 flows through the second passage 29*a*. The second passage 29*a* is connected to the first connection hole 29*b* and the second connection hole 29*c*. The second passage 29*a* extends for a specified length in the second direction X3 from the first connection hole 29*b*. Then, the second passage 29*a* is bent in a third direction X4 crossing the second direction X3, and extends to the second connection hole 29*c*. For example, the third direction X4 conforms to the lengthwise direction of the first injector 24.

The third shaft section 28*d* is inserted into the first connection hole 29*b* and connected to the first connection hole 29*b*. The fuel introduction section 24*a* of the first injector 24 is inserted into the second connection hole 29*c* and connected to the second connection hole 29*c*. The male thread B2*a* of the bolt B2 inserted into the insertion hole 28*e* is threadingly engaged with the female thread 29*d*. Male threads B3*a* of a plurality of bolts B3 are inserted into the plurality of insertion holes 29*e*, respectively. The contact surface 29*f* of the connection unit 29 which contacts the contact surface 28*f* of the connector 28 is a flat surface.

In a state in which the third shaft section 28*d* is inserted into the first connection hole 29*b*, the male thread B2*a* of the bolt B2 inserted into the insertion hole 28*e* is threadingly engaged with the female thread 29*d*, and thus the connector 28 is firmly coupled to the connection unit 29. The male threads B3*a* of the plurality of bolts B3 inserted into the plurality of insertion holes 29*e*, respectively, are threadingly engaged with female threads 17*e* of the throttle body 17, respectively, and thus connection unit 29 is firmly coupled to the throttle body 17. In a state in which the fuel introduction section 24*a* of the first injector 24 is inserted into the second connection hole 29*c*, the connection unit 29 is firmly coupled to the first injector 24, and thus the connector 28 is firmly coupled to the first injector 24 via the connection unit 29. In the above-described manner, the connector 28 is firmly coupled to the connection unit 29 and firmly coupled to the first injector 24 via the connection unit 29.

As described above, in the motorcycle 1, since the connector 28 is coupled to the first injector 24, it is not necessary to connect to the second end 26*b* of the first fuel tube 26 and the first injector 24, a sub-tube for flowing the fuel F from the first fuel tube 26 toward the first injector 24. Thus, the first and second fuel tubes 26, 27 can be arranged in series. As a result, the fuel tube pipe structures connecting the fuel pump 30 to the first and second injectors 24, 25 can be simplified.

Since the connector 28 is firmly coupled to the first injector 24, the relative positions of the coupling portions of the connector 28 and the first injector 24 are not changed. Therefore, it becomes possible to prevent the first and second fuel tubes 26, 27 from being displaced with respect to the first injector 24.

Therefore, it becomes possible to prevent a situation in which the first and second fuel tubes 26, 27 contact, interfere with or get tangled in other members of the motorcycle 1, without providing a complex structure as the fuel tube pipe structures of the first and second fuel tubes 26, 27 disposed in the inner space S.

Since the connector 28 is connected to the first and second fuel tubes 26, 27 in the flow direction X1, the lengths of the first and second fuel tubes 26, 27 can be reduced, and the fuel tube pipe structures can be easily made compact in the flow direction X1. Since the connector 28 is connected to the first injector 24 in the direction crossing the flow direction X1, the fuel F can be easily delivered to the first injector 24 from the first fuel tube 26 via the connector 28, without stretching the first fuel tube 26 or the second fuel tube 27 in the direction crossing the flow direction X1.

Since the first and second fuel tubes 26, 27 are connected to the connector 28 firmly coupled to the first injector 24, the first and second fuel tubes 26, 27 can be mounted on the vehicle body while stably positioning the first and second fuel tubes 26, 27 without using positioning members, in a state in which the first and second fuel tubes 26, 27 are connected to the connector 28 in the flow direction X1. Compared to a conventional example in which the fuel tubes are required to be mounted on the vehicle body of the vehicle by use of the positioning members, the mounting structure for mounting the fuel tube pipe structures on the vehicle body of the motorcycle 1 does not become complex.

Since the first and second fuel tubes 26, 27 are connected to the connector 28 firmly coupled to the first injector 24, a direction in which the first and second fuel tubes 26, 27 are connected to each other, and a direction in which the connector 28 and the first injector 24 are connected to each other are not changed. In this configuration, even when a vibration is transmitted to the first and second fuel tubes 26, 27 while the motorcycle 1 is traveling, the direction in which the first and second fuel tubes 26, 27 are connected to each other, and the direction in which the connector 28 and the first injector 24 are connected to each other can be stably maintained.

At least one of the first and second fuel tubes 26, 27 is connected to the connector 28 in such a manner that at least one of them is relatively rotatable in the circumferential direction of the first fuel tube 26, with respect to the connector 28. In this configuration, in a case where the first fuel tube 26 or the second fuel tube 27 is moved, at least one of the first and second fuel tubes 26, 27 is relatively rotated in the circumferential direction of the first fuel tube 26 with respect to the connector 28, while maintaining the relative positions of the coupling portions of the connector 28 and the first injector 24. This makes it difficult to deform the first fuel tube 26 or the second fuel tube 27.

For example, in a case where a work for detaching the fuel pump 30 from the vehicle body together with the fuel tank 4 is performed, it becomes possible to prevent a situation in which the relative positions of the coupling portions of the connector 28 and the first injector 24 are changed, and thereby the fuel tube pipe structures contact, interfere with or get tangled in other members of the motorcycle 1. In addition, it becomes possible to prevent the first fuel tube 26 or the second fuel tube 27 from being twisted or broken. Thus, work efficiency can be improved.

Since the first fuel tube 26 is curved at two points in different directions, the first fuel tube 26 can be easily disposed in the inner space S while preventing a situation in which the first fuel tube 26 contacts, interferes with or gets tangled in other members of the motorcycle 1.

Since the first fuel tube 26 is curved at two points in different directions, a distance between the fuel pump 30 and the first injector 24 can be made different between a state in which the fuel pump 30 is mounted on the vehicle body and a state in which the fuel pump 30 is detached from the vehicle body. Therefore, in the state in which the fuel pump 30 is mounted on the vehicle body, the first fuel tube 26 can be compactly accommodated in the inner space S. In contrast, in the state in which the fuel pump 30 is detached from the vehicle body, the first injector 24 and the fuel pump 30 can be made distant from each other by stretching the first fuel tube 26, and the fuel pump 30 and the first fuel tube 26 can be easily lifted up.

By stretching the first fuel tube 26 in a state in which the connector 28 is firmly coupled to the first injector 24, it becomes possible to prevent a situation in which the fuel tube pipe structures, which are other than the first fuel tube 26, are lifted up and get tangled in other members of the motorcycle 1. Therefore, the work for detaching the fuel pump 30 from the vehicle body can be performed with high efficiency.

In a case where the fuel pump 30 is detached from the vehicle body, the first injector 24 and the fuel pump 30 can be made distant from each other by stretching the first fuel tube 26. This makes it possible to increase the efficiency of, for example, a work for detaching the first fuel tube 26 from the fuel pump 30 or the connector 28 and mounting the first fuel tube 26 on the fuel pump 30 or the connector 28.

In a case where a work for detaching the fuel pump 30 mounted on the fuel tank 4 from the vehicle body, together with the fuel tank 4, in a state in which the fuel pump 30 is mounted on the lower portion of the fuel tank 4, and the first fuel tube 26, the second fuel tube 27, and the connector 28 are disposed below the fuel tank 4, it becomes possible to prevent a situation in which the fuel tube pipe structures are lifted up from a location that is below the fuel tank 4, and get tangled in other members of the motorcycle 1, because the connector 28 is firmly coupled to the first injector 24. Thus, the work efficiency can be improved.

Since the fuel pump 30 is mounted on the lower portion of the fuel tank 4, and the first injector 24 is positioned to overlap with the fuel tank 4 in the vertical direction, the fuel pump 30 and the first injector 24 can be disposed to be close to each other, at a location below the fuel tank 4. In this layout, the length of the first fuel tube 26 can be reduced, and the fuel tube pipe structures can be easily made compact.

As described above, the motorcycle 1 is the Motocrosser. A maintenance work or setting for the motorcycle 1 is performed more frequently than those for other kinds of motorcycles. For this reason, the fuel tank 4 is frequently detached from the vehicle body. In the motorcycle 1 which is the Motocrosser, since the first fuel tube 26 can be easily lifted up together with the fuel tank 4, an operator can easily access the inner space S, from an outside region. While the first fuel tube 26 is lifted up together with the fuel tank 4, it becomes possible to prevent the first and second fuel tubes 26, 27 from getting tangled in other members of the motorcycle 1. Therefore, the maintenance work for the motorcycle 1 can be performed easily and quickly, even if the maintenance work is performed frequently.

In the configuration which uses the first joint member 34 and the first fastening member 35, for example, in a case where the fuel pump 30 is detached from the vehicle body together with the first fuel tube 26, the fuel pump 30 and the first fuel tube 26 can be easily detached from the vehicle body by pulling the second end **26*b* of the first fuel tube 26 or the first end of the connector 28 out of the first joint member 34, while maintaining a state in which the second fuel tube 27 is fastened to the connector 28 with a relatively simple structure by use of the first fastening member 35. Since the second fuel tube 27 is fastened to the connector 28 by use of the first fastening member 35, it is not necessary to increase the length of the second fuel tube 27 to allow the second fuel tube 27 to be provided with the first fastening member 35**. Therefore, the fuel tube pipe structures can be easily made compact.

In the motorcycle 1, in a state in which the throttle body 17 is connected to the engine 3, the air cleaner 16 is connected to the throttle body 17, and the fuel pump 30 is positioned so that a distance between the fuel pump 30 and the throttle body 17 is smaller than a distance between the fuel pump 30 and the air cleaner 16, the first injector 24 is connected to the throttle body 17 and the second injector 25 is connected to the air cleaner 16. In this configuration, the first and second fuel tubes 26, 27 are arranged in series in a direction from the fuel pump 30 toward the air cleaner 16 to which the second injector 25 is connected, by way of the throttle body 17 to which the first injector 24 is connected. Therefore, in this layout, the fuel F can be injected from the first injector 24 into the inner passage **17*a* of the throttle body 17, and the fuel F can be injected from the second injector 25 into the inner passage 16*a* of the air cleaner 16**, while simplifying the fuel tube pipe structures.

In a case where the motorcycle 1 includes the single-cylinder engine 3 which generates the driving power for allowing the motorcycle 1 to travel, the first and second fuel tubes 26, 27 can be arranged in series in the flow direction X1, and the fuel tube pipe structures can be easily formed to have a linear shape having one or more branch points, by providing the first and second injectors 24, 25 on the single air-intake passage 21 through which the intake-air to be supplied to the engine 3 flows. Therefore, it becomes possible to prevent the fuel tube pipe structures from becoming complex, and efficiently dispose the fuel pump 30, the first and second injectors 24, 25, and the first and second fuel tubes 26, 27 in the inner space S.

The present invention is not limited to the above-described embodiment. The above-described configuration may be changed, added to or deleted from, within a scope of the spirit of the preset invention. The vehicle is not limited to the Motocrosser, and may be other kinds of motorcycles, or other kinds of vehicles such as a three-wheeled vehicle, personal watercraft (PWC), a snow mobile, and an all terrain vehicle (ATV)

Numerous improvements and alternative embodiment of the invention will be apparent to those skilled in the art in view of the foregoing description. Accordingly, the description is to be construed as illustrative only, and is provided for the purpose of teaching those skilled in the art the best mode of carrying out the invention. The details of the structure and/or function may be varied substantially without departing from the spirit of the invention.

The invention claimed is:

1. A vehicle which supplies a fuel stored in a fuel tank to an air-intake passage through which intake-air flows, the intake-air being supplied to an engine which generates driving power for allowing the vehicle to travel, the vehicle comprising:

a first injector which injects the fuel into the air-intake passage;

a second injector which is disposed to be apart from the first injector along a flow direction of the intake-air flowing through the air-intake passage and injects the fuel into the air-intake passage;

a fuel pump which discharges the fuel from the fuel tank;

a first fuel tube, a first end of which is connected to the fuel pump;

a second fuel tube, a first end of which is connected to the second injector; and a connector which is connected to a second end of the first fuel tube, a second end of the second fuel tube, and the first injector, and distributes the fuel which has flowed through the first fuel tube, to the second fuel tube and the first injector, wherein the connector is firmly coupled to the first injector, wherein at least one of the first fuel tube and the second fuel tube is connected to the connector in such a manner that at least one of the first and second fuel tubes is relatively rotatable in a circumferential direction of the first fuel tube, with respect to the connector, wherein the first fuel tube and the second fuel tube are arranged in series, the first and second fuel tubes being spaced apart in a forward and rearward direction and longitudinally extending in the forward and rearward direction, and wherein the first end of the first fuel tube is located forward of the connector, and the first end of the second fuel tube is located rearward of the connector.

2. The vehicle according to claim 1, wherein the connector is connected to the first fuel tube and the second fuel tube along the air-intake passage, and connected to the first injector so that the connector crosses the air-intake passage.

3. The vehicle according to claim 1, wherein the first fuel tube is curved at two points in different directions.

4. The vehicle according to claim 1, wherein the fuel pump is mounted on a lower portion of the fuel tank, wherein the first fuel tube, the second fuel tube, and the connector are disposed below the fuel tank, and wherein the first injector is disposed to overlap with the fuel tank in a vertical direction.

5. The vehicle according to claim 1, further comprising:

a joint into which the second end of the first fuel tube and a first end of the connector are inserted, the joint being engageable with the second end of the first fuel tube or the first end of the connector to connect the first fuel tube and the connector to each other in such a manner that the first fuel tube and the connector are detachable from each other; and a clamp member which is provided on an outer periphery of the second end of the second fuel tube, and externally presses connection portions of the second fuel tube and the connector to fasten the second fuel tube to the connector.

6. The vehicle according to claim 1, further comprising:

a throttle body connected to the engine; and an air cleaner connected to the throttle body, wherein the fuel pump is positioned so that a distance between the fuel pump and the throttle body is smaller than a distance between the fuel pump and the air cleaner, wherein the air-intake passage includes an inner passage of the throttle body and an inner passage of the air cleaner, and wherein the first injector is connected to the throttle body, and the second injector is connected to the air cleaner.

7. The vehicle according to claim 1, wherein the vehicle is a motorcycle, and wherein the engine is a single-cylinder engine.

8. The vehicle according to claim 1, wherein the fuel pump is mounted on a lower portion of the fuel tank, wherein the first fuel tube is disposed below the fuel tank, and wherein the first fuel tube includes a bent portion positioned closer to the first end of the first fuel tube than to the second end of the first fuel tube, the bent portion being bent at a right angle toward the first end of the first fuel tube when viewed from the second end of the first fuel tube.

* * * * *